US006065963A

United States Patent [19]

Dewaegheneire et al.

[11] Patent Number: 6,065,963

[45] Date of Patent: May 23, 2000

[54] CONICAL SURFACE BURNER

[75] Inventors: Gabriel Dewaegheneire, Zwevegem, Belgium; Willy Marrecau, Rome, Ga.; Philip Vansteenkiste, Deerlijk, Belgium

[73] Assignees: N.V. Bekaert S.A.; N.V. Acotech S.A., both of Belgium

[21] Appl. No.: 09/142,483

[22] PCT Filed: Jan. 6, 1998

[86] PCT No.: PCT/EP98/00026

§ 371 Date: Oct. 8, 1998

§ 102(e) Date: Oct. 8, 1998

[87] PCT Pub. No.: WO98/30839

PCT Pub. Date: Jul. 16, 1998

[30] Foreign Application Priority Data

Jan. 10, 1997 [BE] Belgium ..... 9700027

[51] Int. Cl.[7] ..... F23D 14/14

[52] U.S. Cl. ..... 431/329

[58] Field of Search ..... 431/329, 100, 431/7; 126/92 AC

[56] References Cited

U.S. PATENT DOCUMENTS

| | | | |
|---|---|---|---|
| 2,255,298 | 9/1941 | Reichhelm | 431/329 |
| 3,269,449 | 8/1966 | Witten, Jr. . | |
| 3,379,000 | 4/1968 | Webber et al. . | |
| 4,597,734 | 7/1986 | McCausland et al. . | |
| 4,657,506 | 4/1987 | Ihlenfield et al. . | |
| 4,881,893 | 11/1989 | Mellini | 431/100 |
| 4,930,199 | 6/1990 | Yanagisawa . | |
| 5,165,887 | 11/1992 | Ahmady . | |

FOREIGN PATENT DOCUMENTS

| | | | |
|---|---|---|---|
| 0 157 432 | 10/1985 | European Pat. Off. . | |
| 0 245 084 | 11/1987 | European Pat. Off. . | |
| 52-46538 | 4/1977 | Japan | 431/329 |
| WO 93/18342 | 9/1993 | WIPO . | |
| WO 94 01373 | 1/1994 | WIPO . | |

OTHER PUBLICATIONS

Patent Abstracts of Japan, vol. 096, No. 006, Jun. 28, 1996 & JP 08 028824 A (Rinnai Corp; Others: 01), Feb. 2, 1996, see abstract.

*Primary Examiner*—Ira S. Lazarus
*Assistant Examiner*—Sara Clarke
*Attorney, Agent, or Firm*—Nixon and Vanderhye PC

[57] ABSTRACT

A surface burner for gas has a gas supply chamber (5) provided with a gas outlet side enclosed by a conically shaped burner membrane (2) fixed to a support net (1). A coupling element (3) connects the chamber (5) with gas supply (4). The burner membrane (2) includes a non-sintered fabric-type structure made of heat resistant stainless steel fiber bundles of individual fibers, wherein the individual fibers have a substantially parallel arrangement and an equivalent fiber diameter of between 1 and 150 $\mu$m.

8 Claims, 2 Drawing Sheets

CONICAL SURFACE BURNER

The invention relates to a conical surface burner with a non-sintered, fabric-type metal fibre structure as burner membrane. This fibre structure can be knitted, knotted, braided or woven.

Conventional burners with prismatic or cylindrical surfaces have the disadvantage during use that at the end of the burner (in the direction of the gas flow) a gas pressure builds up which is higher than the average gas pressure in the combustion chamber. As a consequence, a flaring flame is frequently observed at this end. These conventional burners thus are often not capable of producing homogeneous combustion over the entire surface of the burner without the installation of pressure distribution elements, which result in an extra pressure drop and are considerably more labourintensive to manufacture.

The use of sintered metal fibre webs as burner membranes in surface burners is known from patent EP 0157432. The problems of non-uniform gas flow over the membrane surface associated with this type of membrane were partially solved by providing the sintered porous metal fibre plate with a regular pattern of openings, as described in WO 93/18342 of the applicant. The problem of obstructed thermal expansion remained, however, since the membrane plates should be able to expand in all directions and then contract, in accordance with the heating and cooling cycles. The plates often possess a considerable surface area, however, and are mounted in a fixed peripheral frame, so that the thermal expansion cannot take place unobstructedly. During use, this leads to uncontrollable deformation phenomena.

In contrast to the conventional sintered membranes, a non-sintered (for example, knitted) membrane is highly deformable, so that the problems resulting from the thermal expansion of the membrane are avoided, even in burners with a large surface area. Moreover, the knitted metal fibre membranes are capable of producing homogenous combustion, both in the radiation mode and in the blue-flame mode.

Furthermore, as a result of the very open knitted structure, no filter is required for the gas mixture which is to be burned. Additionally, the chance of flame resonance is very small, with the consequence that the disturbing whistling sounds are avoided. The knitted membranes also offer the advantage that the time required for warming up and cooling down (response time) is extremely short, so that a very great amount of variation in heat flux can be realized in a very short time span (in the order of seconds). Hence, the change-over from one burning mode to another takes place very smoothly. The quick response is very beneficial from the standpoint of safety.

It is an object of the invention to provide a surface burner in which the change of pressure of the gas/air mixture flowing through the gas supply chamber is uniform and the flaring of the flames at the end of the burner is greatly diminished in comparison to many conventional burners. To this end, the burner membrane has a cone-shaped surface, whether truncated or not, and is composed of non-sintered metal fibres. This burner enables to obtain homogeneous combustion over the entire surface of the burner, without any particular fittings or partitions being required in the chamber, which would considerably increase the pressure drop in the flow through the burner. Depending on the dimensions of the burner and the heat flux in question, the pressure drop in the flow through a burner according to the invention is generally two to three times lower than the pressure drop in the flow through the known conventional burners.

More specifically, the invention provides a surface burner for gas comprising a gas supply chamber enclosed by a burner membrane at its gas outlet side and a coupling element to connect it with the gas supply means, in which the surface of the membrane is conically shaped, and in which the membrane is fixed to a support net at the gas supply side of the membrane. The burner membrane consists of a non-sintered fabrictype structure made of stainless steel fibres having an equivalent diameter of between 1 and 150 $\mu$m.

The "equivalent diameter of a fibre" is the diameter of a fictive round fibre with the same cross-sectional surface area as the actual fibre.

In particular the fabric type structure of the surface burner membrane of the invention comprises heat resistant stainless steel fibre bundles wherein the fibres have a substantially parallel arrangement in the bundles.

An embodiment of such a burner will be described below with reference to FIGS. 1 and 2. The advantages will also be further discussed.

Figure 3:
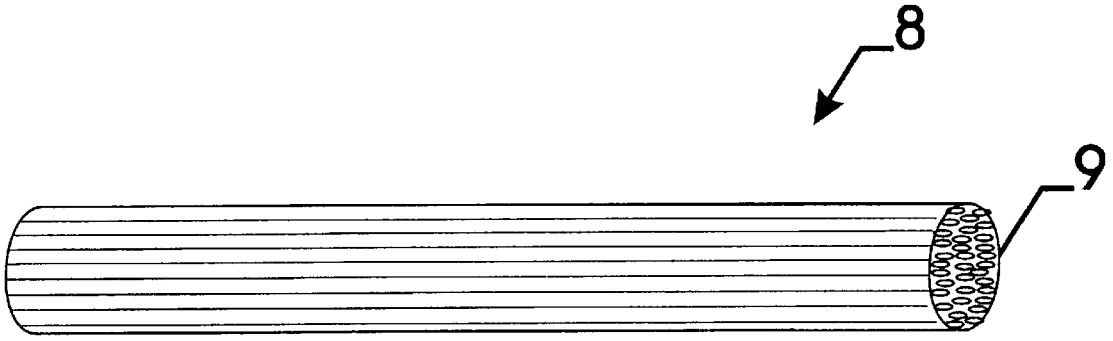

FIG. 3 schematically shows a bundle of steel fibers.

The construction of the burner according to the invention is very simple. Three steps can be distinguished in the construction process.

In the first step, a conical form is made out of netting 1, which defines the boundaries of the gas supply chamber 5.

This net 1 serves as a rigid support for the burner membrane 2 and makes the burner very sturdy.

In the second step, the burner membrane 2 is attached to this net 1, for example by means of spot welding operations. This attachment of the membrane is done over the entire length of a longitudinal edge 7 and on the edges around the end surfaces of the conical form. The burner membrane composed of heat-resistant stainless steel fibres (for example, FeCralloy®, NiCralloy® or Aluchrome®) is in the present example a knitted structure. The metal fibres can be obtained from the melt, by means of bundled drawing (U.S. Pat. No. 3,379,000) or by means of shaving the edge of a metal foil (U.S. Pat. No. 4,930,199), and they generally have an equivalent diameter of less than 150 $\mu$m. The weight of the knitted fabrics used in such applications can vary from between 500 and 3000 g/m$^2$. Burners are produced with membranes made of fibres obtained by means of shaving the axial end edge of a roll of metal foil, hereafter called NIT fibres. These burner membranes had weights, for example, of 1240, 1860 or 2130 g/m$^2$.

The very openly knitted structure has a large permeability, often makes the filtration of the combustion air unnecessary, and lowers the probability of sound resonance. The pressure drop through the membrane is also much lower than with many conventional burners.

Finally, in the third step a coupling element 3 is welded onto the gas inflow side of the burner (at the outside of the support net). This element forms the joint with the gas supply duct 4.

Figure 1:
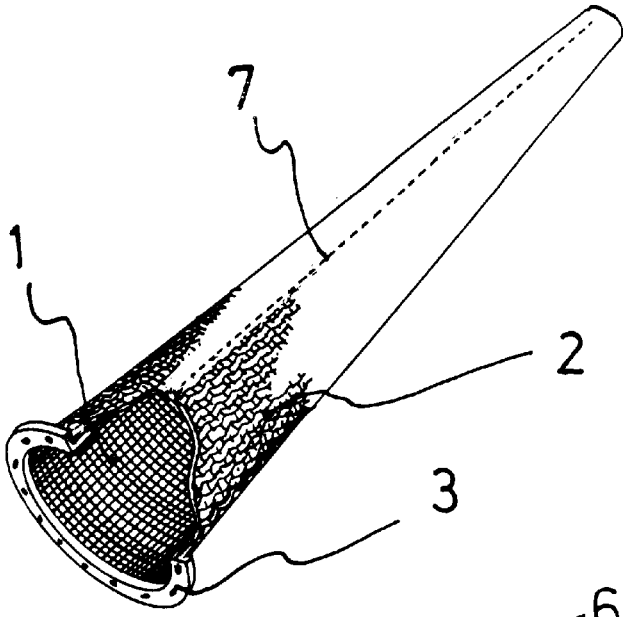
FIG. 1 is a schematic representation of a burner according to the invention.
Figure 2:
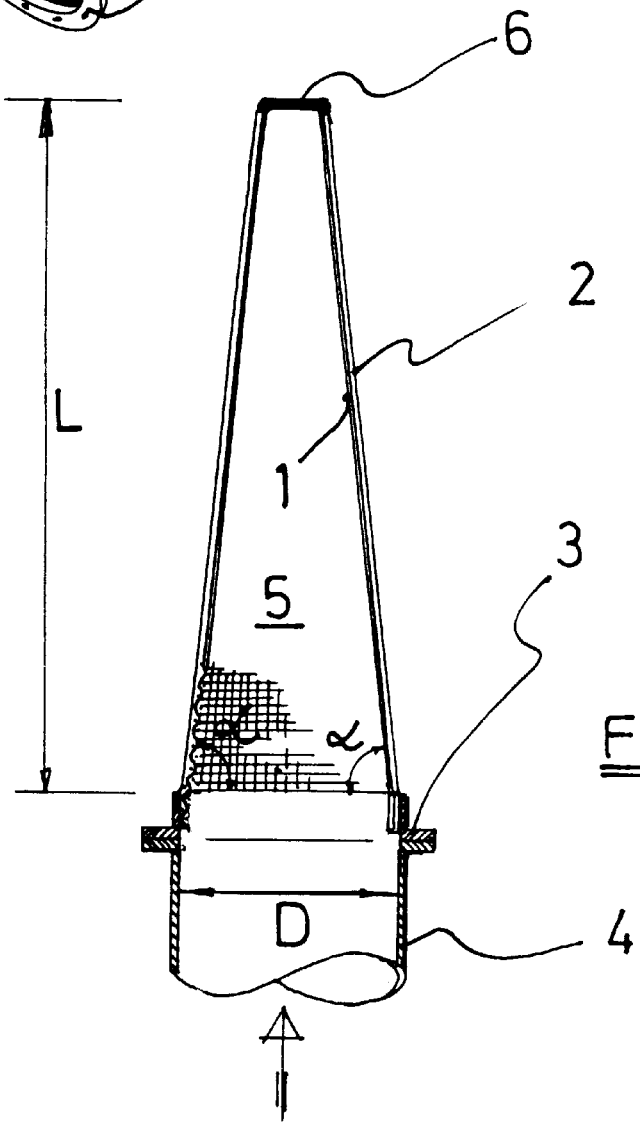
FIG. 2 is a sketch of the lateral cross-section of a burner according to the invention.

The angle of inclination $\alpha$ of the conical form, as indicated in FIG. 2, is between 45 and 88 degrees, and preferably between 65 and 88 degrees. Furthermore, the ratio of the length L of the burner to the diameter D of the base of the burner L/D (L and D as indicated in FIG. 2) is by preference between 1 and 10. The length L of the burner can vary between 5 cm and 5 m, preferably it is below 3 m and most preferably between 10 cm and 2 m.

EXAMPLES

In practice, a burner has been produced, for example, with a knitted structure made of NIT fibres as the burner membrane (1,200 g/m$^2$) and with the following dimensional characteristics L=1 m, D=125 mm (L/D=8), and $\alpha$=86.5. At a heat flux of 2700 kW/m$^2$, the pressure drop over this burner was only 300 Pa.

As a second (non-limiting) example, a burner can be mentioned having a membrane of the same type and the following dimensions: L=15 cm, D=34 mm (L/D=4.4), and $\alpha$=84. At a heat flux of 3100 kW/m$^2$, the pressure drop over this second burner was only 80 Pa.

The burner membrane mentioned in both of the examples above was made as follows. Bundles of substantially straight and parallel NIT fibres were held together by means of a continuous synthetic filament twisted in a spiral form around the fibre bundles. FIG. 3 shows a bundle 8 of individual stainless steel fibers 9 which have a substantially parallel arrangement. The individual steel fibers have an equivalent diameter of between 1 $\mu$m and 150 $\mu$m. The bundle thus wrapped was then processed on a double-bedded flatbed knitting machine (gauge 7) into a simply structured knitted construction such as, for example, interlock or tourrond. Afterwards, the synthetic filament was removed by burning. Due to the essentially parallel arrangement of the fibres in the bundle, the knitted fabric possesses a fairly flexible, voluminous structure. Fabrics knitted from bundles of metal fibres of the applicant's Bekitherm® KN/C type can also be utilized. The metal fibres in these fabrics are obtained by bundled drawing. The conical fabric can also be produced on a circular knitting machine.

A consequence of the conical shape of the burner according to the invention is that only a very low pressure accumulation is required to produce extraordinarily homogeneous combustion, both in the radiation mode and in the blue-flame mode, up to fluxes of well above 5000 kW/m$^2$. The conical shape prevents the build-up of higher gas pressure at the end 6 of the burner (viewed in the direction of the flow of gas), so that a flaring flame is no longer observed there, as was the case with the conventional cylindrical burners equipped with whatever membrane.

The burner according to the invention is very safe to operate since flashback does not occur and its thermal expansion can take place unhindered. Moreover, the burner offers great resistance to extreme thermal shocks and is mechanically very sturdy. Furthermore, the burner is characterized by a very rapid response: the time required for change-over of burner modes and the cooling time are very short (up to less than 1 second).

As a variant of the construction described above, the burner can be provided with partitions which, for example, are mounted parallel or essentially parallel to the longitudinal axis of the conical form within the conical chamber. These partitions can promote an even more homogenous gas flow.

A second variant consists in approximating the conical form of the burner surface with a polygonal pyramid surface.

It is also possible to opt for a cone with an oval instead of a circular base. In addition, the shape of the base of the cone near the coupling element 3 can differ from the shape of the end surface at the opposite end 6 of the chamber 5. It is even possible to opt for a membrane with a spherical dome shape.

If so desired, the mesh size and/or the thickness of the knitted structure can be varied somewhat over the length or circumference of the cone. Such knitted fabrics with varying mesh sizes, elasticity and fabric thickness are known as such from WO 94/01373.

In combination with the mounting of specially adapted (possibly adjustable) partitions, all types of flow profiles can thus be designed in the chamber for the purpose of obtaining a more or less homogeneous combustion front over the entire burner surface.

The applications of the burners according to the invention are very diverse in nature, such as for example residential water heaters, industrial boilers and water heaters, infrared radiators for industrial operations, and in the food industry.

We claim:

1. A surface burner for gas, comprising a support net;

a gas supply chamber having a gas outlet side, said gas outlet side being enclosed by a burner membrane having a conically shaped surface and being attached to said support net; and a coupling element to connect said chamber with a gas supply, wherein said burner membrane comprises a non-sintered fabric-type structure made of heat resistant stainless steel fiber bundles of individual fibers, and wherein the individual fibers of said burner membrane have a substantially parallel arrangement and an equivalent fiber diameter of between 1 and 150 $\mu$m.

2. A burner according to claim 1, in which the burner membrane is comprised of a knitted fabric structure.

3. A burner according to claim 2, in which the weight of the knitted fabric structure is between 500 and 3000 g/m$^2$.

4. A burner according to claim 1, wherein the conically shaped surface of the burner membrane has an angle of inclination a which is between 45 and 88 degrees.

5. A burner according to claim 4, wherein the angle of inclination a is between 65 and 88 degrees.

6. A burner according to claim 4, said burner membrane has a length/diameter ratio L/D which is between 1 and 10.

7. A burner according to claim 4, said burner membrane has a length L of between 5 cm and 5 m.

8. A burner according to claim 7, said burner membrane has a length L of between 10 cm and 2 m.

* * * * *